US010012469B2

(12) United States Patent
Cummings

(10) Patent No.: US 10,012,469 B2
(45) Date of Patent: Jul. 3, 2018

(54) HANDHELD TOY PROJECTILE LAUNCHER WITH SPRING LOADED SPOOL

(71) Applicant: Peter Cummings, Tsim Sha Tsui (HK)

(72) Inventor: Peter Cummings, Tsim Sha Tsui (HK)

(73) Assignee: KMA Concepts Limited, North Point (HK)

( * ) Notice: Subject to any disclaimer, the term of this patent is extended or adjusted under 35 U.S.C. 154(b) by 128 days.

(21) Appl. No.: 14/162,088

(22) Filed: Jan. 23, 2014

(65) Prior Publication Data

US 2015/0204634 A1 Jul. 23, 2015

(51) Int. Cl.

| | |
|---|---|
| ***F41B 7/08*** | (2006.01) |
| ***A63H 27/14*** | (2006.01) |
| ***A63H 33/18*** | (2006.01) |
| ***A63H 27/00*** | (2006.01) |

(52) U.S. Cl.

CPC ..... *F41B 7/08* (2013.01); *A63H 27/005* (2013.01); *A63H 27/14* (2013.01); *A63H 33/18* (2013.01)

(58) Field of Classification Search

CPC . F41B 3/02; F41B 7/08; A63H 27/005; A63H 27/14; A63H 33/18

USPC ..... 124/20.1

See application file for complete search history.

(56) References Cited

U.S. PATENT DOCUMENTS

| | | | | |
|---|---|---|---|---|
| 4,587,943 A * | 5/1986 | Ross | F41B 3/02 | 124/20.1 |
| 5,282,453 A * | 2/1994 | Chia | F42B 6/00 | 124/20.1 |
| 8,683,960 B2 * | 4/2014 | O'Brien | A01K 27/004 | 119/796 |
| 2012/0160224 A1 * | 6/2012 | Walterscheid | F41B 5/0094 | 124/20.1 |

* cited by examiner

*Primary Examiner* — Gene Kim
*Assistant Examiner* — Jeffrey Vanderveen
(74) *Attorney, Agent, or Firm* — LaMorte & Associates P.C.

(57) ABSTRACT

A launching system that launches a toy projectile. A launcher is provided that contains a handle and an elastic element that extends from the handle. A spool is provided inside the handle. The spool is spring biased by a torsion spring. The elastic element is anchored to the spool inside the handle and is at least partially wound around the spool. As the elastic element unwinds from the spool, the spool rotates in opposition of the torsion spring and stores spring energy in the torsion spring. The elastic element has a free end that extends out of the handle. The free end is terminated with a connector. A toy projectile is provided. The toy projectile has a receptacle that selectively receives the connector.

5 Claims, 3 Drawing Sheets

HANDHELD TOY PROJECTILE LAUNCHER WITH SPRING LOADED SPOOL

BACKGROUND OF THE INVENTION

1. Field of the Invention

In general, the present invention relates to toy launcher systems that use an elastic element to launch a projectile into flight. More particularly, the present invention relates to the structure of the projectile launcher and the mechanisms that interconnect the elastic elements with the projectile launcher.

2. Prior Art Description

Ever since the invention of the rubber band, children have connected the rubber band to a handle and used the rubber band and handle as a launcher for various projectiles. Many toy manufacturer's have adapted this basic design to lunch various toys into flight. Many toy rockets, toy airplanes and the like come with a handheld launcher, wherein the handheld launcher includes an elastic band anchored to a static handle.

A problem associated with such prior art handheld launchers is its failure mode. If an elastic band is drawn beyond its limit, then the band may break. Furthermore, if the projectile is pulled too hard against the elastic band, the projectile may cut into the elastic band and cause it to break. Depending upon where the breakage occurs, the broken elastic element may fly toward the person holding the launcher as the stored energy is accidentally released. The broken elastic element, therefore, has the potential to cause physical harm to the child playing with the toy.

One of the greatest contributing factors to the breaking of an elastic element, is degradation in the elastic element caused by exposure to UV light. Many toy launchers that have elastic elements use elastic elements that are made from a synthetic polymer, such as silicon, TPR, or some other synthetic rubber. On the toy, such elastic elements are constantly being stretched and released. After a given number of stretch and release cycles, elastic elements eventually begin to degrade, crack and then break. Most all plastic degrades in some fashion over time. It has been found that one of the greatest causes of degradation in the preferred polymers used for the launchers is to expose the elastic element to UV light. A projectile launcher that can last for years inside a home may only last for a few days if taken outside and left in sunlight. Damage caused by exposure to sunlight has therefore caused customers to return products and/or consumers to be dissatisfied.

A need therefore exists for a toy projectile launcher design that inhibits degradation in the elastic element caused by exposure to light. This need is met by the present invention as described and claimed below.

SUMMARY OF THE INVENTION

The present invention is a launching system that launches a toy projectile. A launcher is provided that contains a handle and an elastic element that extends from the handle. A spool is provided inside the handle. The spool is spring biased by a torsion spring. The elastic element is anchored to the spool inside the handle and is at least partially wound around the spool. As the elastic element unwinds from the spool, the spool rotates in opposition of the torsion spring and stores spring energy in the torsion spring.

The elastic element has a free end that extends out of the handle. The free end is terminated with a connector. A toy projectile is provided. The toy projectile has a receptacle that selectively receives the connector. When the connector on the elastic element engages the receptacle on the toy projectile, the toy projectile can be manually pulled away from the handle. This movement causes the elastic element first to unwind from the spool and then to stretch. When the toy projectile is released, the energy stored in the stretched elastic element and the energy stored in the torsion spring are simultaneously released. This launches the toy projectile into flight at a significant velocity.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention projectile launching system can be embodied in many ways, only one exemplary embodiment of the present invention system is illustrated. This embodiment is selected in order to set forth one of the best modes contemplated for the invention. The illustrated embodiment, however, is merely exemplary and should not be considered limitation when interpreting the scope of the appended claims.

Figure 1:
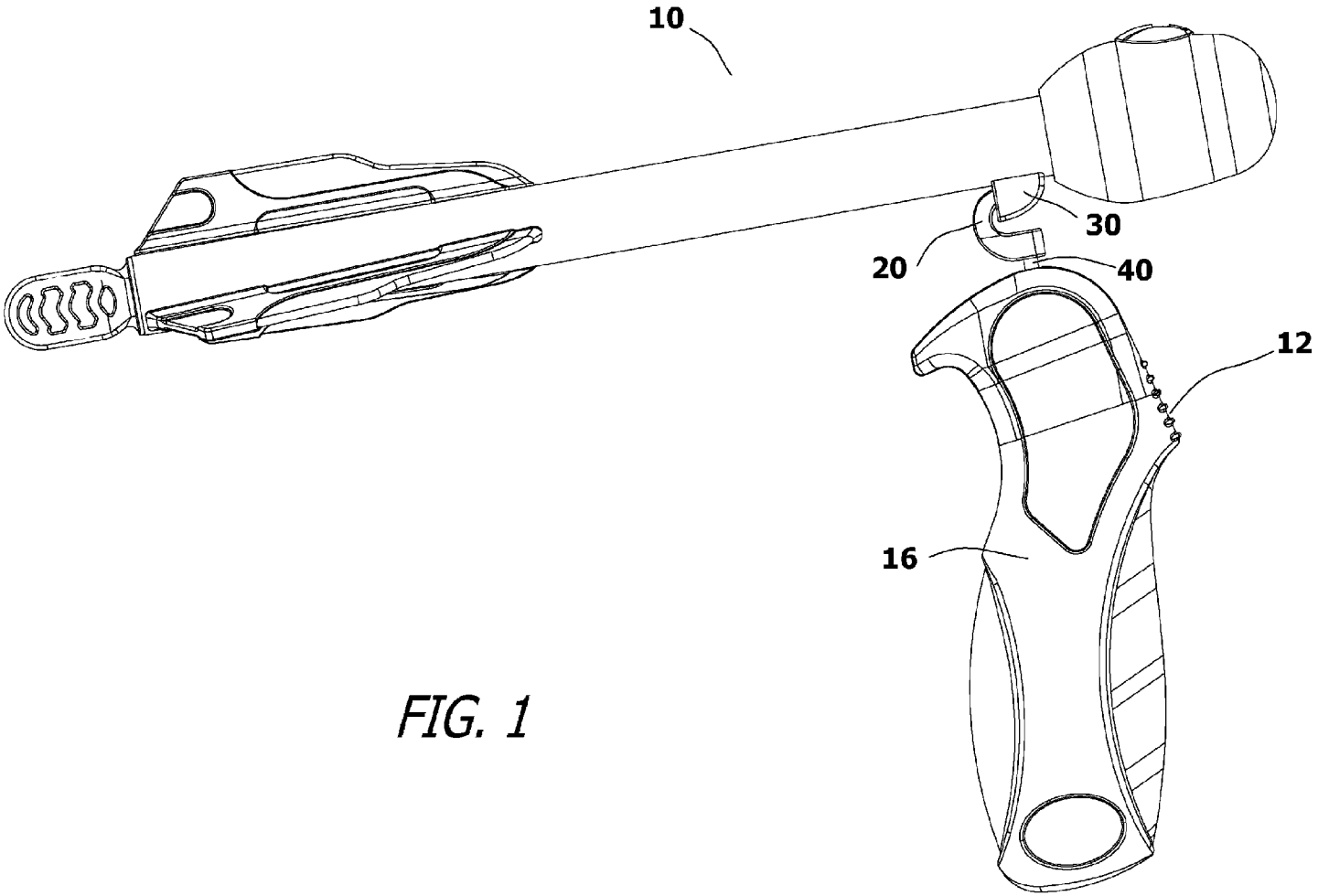
FIG. 1 is a side view of an exemplary embodiment of a launching system containing a toy launcher and a toy projectile in combination.
Figure 2:
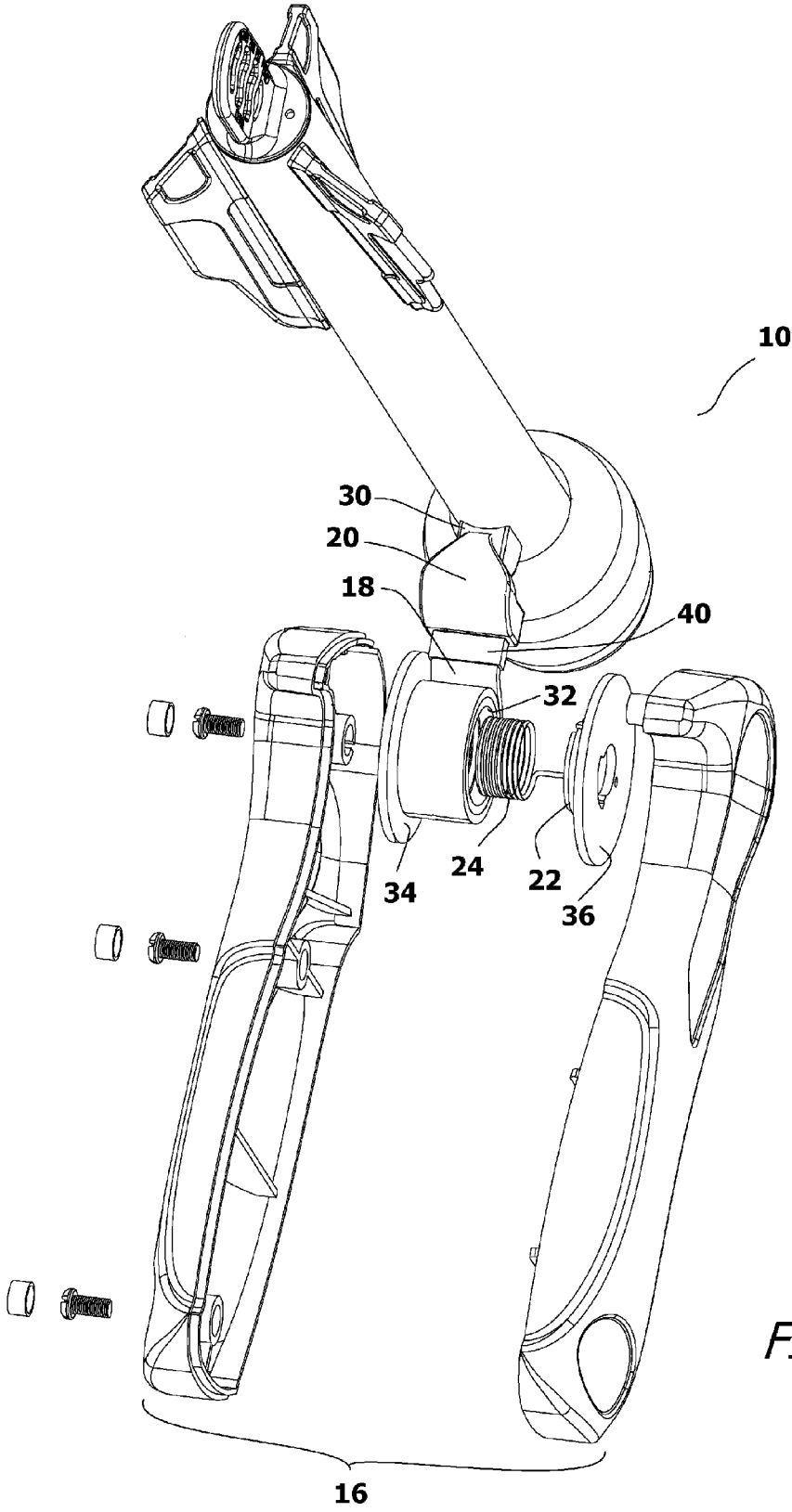
FIG. 2 is an exploded perspective view of the exemplary system of FIG. 1.

Referring to FIG. 1 in conjunction with FIG. 2, a projectile launching system 10 is shown. The projectile launching system 10 includes a launcher 12 and at least one toy projectile 14. The launcher 12 has a handle 16 and an elastic element 18 that extends from the top of the handle 16. The elastic element 18 terminates with a connector 20. The connector 20 is designed to mechanically engage the toy projectile 14. In this manner, a person can grasp the handle 16 of the launcher 12 and hold it at a fixed position. The elastic element 18 can then be engaged with the toy projectile 14, using the connector 20. The toy projectile 14 is pulled in preparation for launching. This applies tension to the elastic element 18.

The elastic element 18 is normally retracted inside the handle 16 so that only the connector 20 at the end of the elastic element 18 is exposed. The retraction is accomplished by anchoring the elastic element 18 to a spring loaded spool 22 inside the structure of the handle 16. The elastic element 18 is wound about the spring-loaded spool 22. The spool 22 is biased into this wound condition by a torsion spring 24. When tension is applied to the elastic element 18 in an amount greater than the spring bias of the torsion spring 24, the elastic element 18 begins to turn the spool 22 and unwind from the spool 22. This stores spring energy in the torsion spring 24. As additional tension is applied to the elastic element 18, the elastic element 18 will eventually fully unwind and will begin to stretch. The stretching of the elastic element 18 stores elastic spring energy in the material of the elastic element 18. When the toy projectile 14 is released, both the spring energy stored in the torsion spring 24 and the elastic spring energy stored in the elastic element 18 is released simultaneously. It will therefore be understood that the force used to propel the toy projectile 14 is provided by both the spring energy stored in the torsion spring 24 and the stretching of the elastic element 18 in tension.

The elastic element 18 has a free end that terminates with the connector 20 and an opposite anchored end that is attached to the spring loaded spool 22. The toy projectile 14 has a receptacle 30 that selectively engages the connector 20. As a person interconnects the connector 20 with the receptacle 30 and pulls on the toy projectile 14, the elastic element 18 first unwinds from the spring loaded spool 22 and then begins to stretch in tension.

The spring loaded spool 22 has a hub 32 around which the elastic element 18 winds. The hub 32 is interposed between two end flanges 34, 36 that complete the spool and guide the elastic element 18 around the central hub 32. The torsion spring 24 is positioned inside the spool 22 to minimize the space required inside the handle 16.

The elastic element can have many cross-sectional profiles. In the illustrated embodiment, the elastic element 18 is configured as a single flat band. However, it should be understood that the elastic element 18 can be an elastic cord or a braiding of multiple elastic cords. Regardless of its cross-sectional shape, the elastic element 18 is made from a highly elastic elastomeric material that enables each of the elastic element 18 to resiliently stretch in length at least threefold without breaking.

It can be seen that the toy projectile 14 has at least one receptacle 30 positioned near the front of the toy projectile 14. The receptacle 30 is sized and shaped to be engaged by the connector 20. To load the toy projectile 14, the toy projectile 14 is engaged with the connector 20 on the elastic element 18. Once the receptacle 30 on the toy projectile 14 is engaged with the connector 20, the toy projectile 14 is pulled back away from the handle 16. As the toy projectile 14 is drawn, the elastic element 18 is pulled in tension. This causes the elastic element 18, to unwind from the spring loaded spool 22. This causes the spool 22 to rotate and the torsion spring 24 to turn and store spring energy. Furthermore, when the elastic element 18 is fully unwound from the spool 22, the elastic element 18 stretches and stores elastic energy.

When the toy projectile 14 is released, the elastic element 18 contracts and releases the stored elastic energy. Likewise, the torsion spring 24 recoils the spool 22 and releases the stored spring energy. As a result, the toy projectile 14 is accelerated using the energy of both the stretched elastic element 18 and the torsion spring 24. The momentum of the toy projectile 14 causes the toy projectile 14 to continue its forward movement beyond the handle 16. This launches the toy projectile 14 into flight as the connector 20 disengages the receptacle 30.

The strength of the torsion spring 24 is preferably coordinated with the strength of the elastic element 18. In this manner, the spool 22 will unwind just as the elastic element 18 reaches its optimal degree of elongation.

Figure 3:
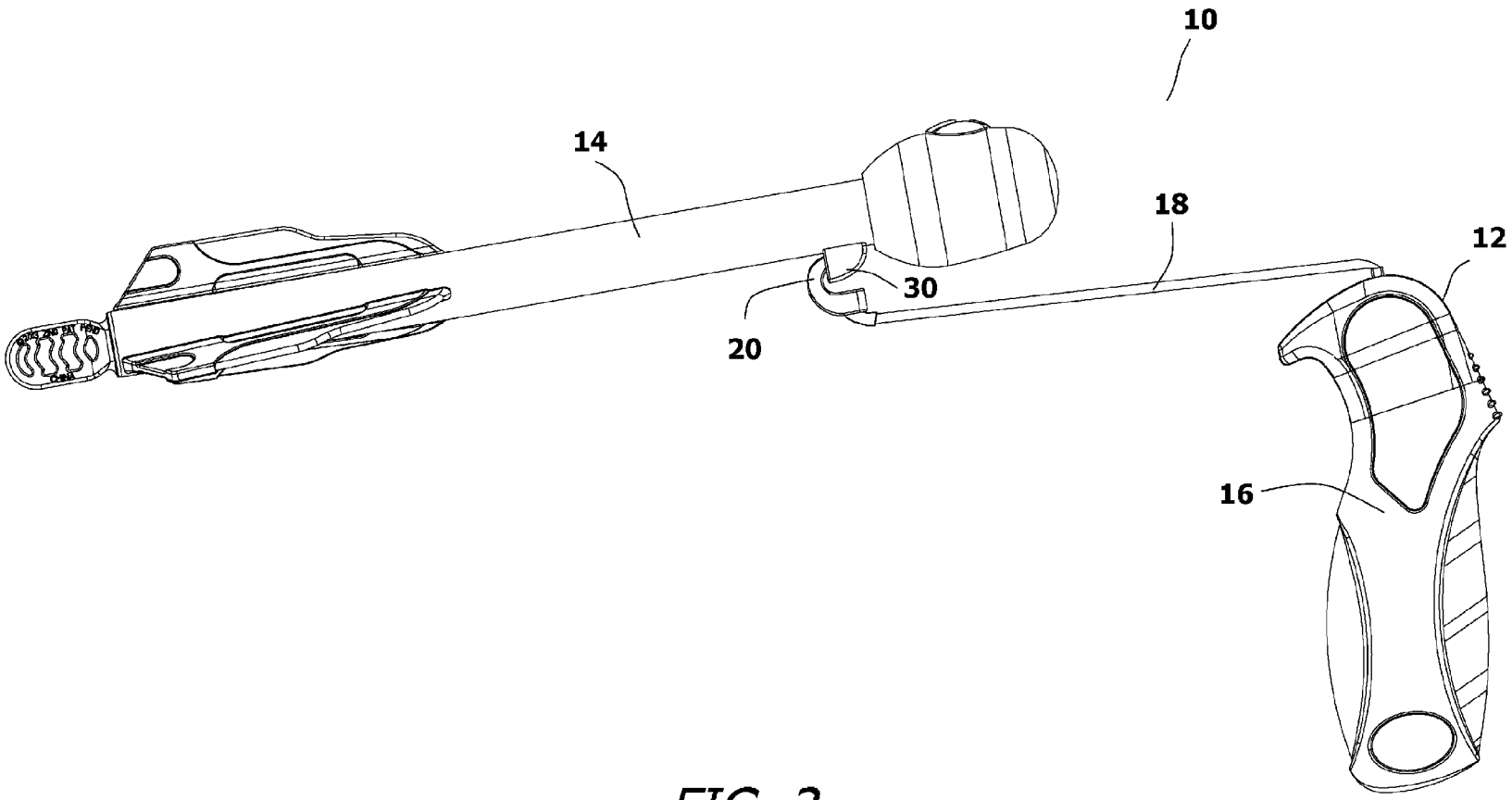
FIG. 3 is a side view of the exemplary system of FIG. 1 with the toy projectile shown in a drawn condition that is ready for launch.

The launcher 12 is normally in the condition shown in FIG. 1. That is, the elastic element 18 is normally unstretched. In this condition, most of the length of the elastic element 18 is wound onto the spool 22. As such, the elastic element 18 is shielded from ambient light and UV damage. Furthermore, the small segment of the elastic element 18 that extends from the handle 16 is protected by a reinforcement collar 40 and is thus protected from ambient light. The only time that the elastic element 18 is exposed to light is when the elastic element 18 is fully stretched (FIG. 3) prior to launching a toy projectile 14. This exposure is only momentary. Thus, during the life of the toy, the elastic element 18 has very little exposure to ambient light and is protected fron UV degradation.

It will be understood that the embodiment of the present invention that is illustrated and described is merely exemplary and that a person skilled in the art can make many variations to that embodiment. For instance, the handle can have many different ornamental shapes. Likewise, the toy projectiles can be configured as airplanes, rocket ships or any other flying projectile. All such embodiments are intended to be included within the scope of the present invention as defined by the claims.

What is claimed is:

1. A toy projectile launching system, comprising:

a toy projectile;

a launcher having a handle;

a spool disposed within said handle;

a torsion spring connected to said spool;

an elastic element at least partially wound around said spool within said handle, wherein said torsion spring stores spring energy when said elastic element is unwound from said spool, therein rotating said spool, and wherein said elastic element has a first end that extends out of said handle; and a connector coupled to said first end of said elastic element outside of said handle, wherein said connector selectively connects with said toy projectile.

2. The system according to claim 1, wherein said spool is shielded from ambient light within said handle.

3. The system according to claim 1, wherein said toy projectile contains a receptacle for selectively receiving said connector.

4. The system according to claim 1, wherein said elastic element has a first end and an opposite second end, wherein said second end is anchored to said spool and said first end terminates with said connector.

5. The system according to claim 1, wherein said torsion spring is disposed inside said spool within said handle.

* * * * *